US009881442B2

(12) United States Patent
Elkhoury

(10) Patent No.: US 9,881,442 B2
(45) **Date of Patent: *Jan. 30, 2018**

(54) GAMING SYSTEM AND METHOD FOR REDEEMING A WINNING TICKET AND/OR A PLURALITY OF NON-WINNING TICKETS HAVING CORRESPONDING SYMBOLS FOR AN AWARD

(71) Applicant: IGT, Las Vegas, NV (US)

(72) Inventor: Rania F. Elkhoury, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/089,066

(22) Filed: Apr. 1, 2016

(65) Prior Publication Data

US 2016/0217648 A1 Jul. 28, 2016

Related U.S. Application Data

(63) Continuation of application No. 14/021,725, filed on Sep. 9, 2013, now Pat. No. 9,305,435.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3213* (2013.01); *G07F 17/329* (2013.01); *G07F 17/3225* (2013.01); *G07F 17/34* (2013.01)

(58) Field of Classification Search

CPC .. G07F 17/329; G07F 17/3213; G07F 17/326; G07F 17/42; A63F 3/065;

(Continued)

(56) References Cited

U.S. PATENT DOCUMENTS

| | | | |
|---|---|---|---|
| 5,092,598 | A | 3/1992 | Kamille |
| 5,265,874 | A | 11/1993 | Dickinson et al. |

(Continued)

OTHER PUBLICATIONS

Florida Lottery Second Chance Drawings & Promotions, Rules—Guy Harvey® Sportsman's Paradise Second Chance Promotion Official Rules, available at http://web.archive.org/web/20130806224151/https://secondchance.flalottery.com/secondchance/rules_2013guyHarvey.do, Aug. 6, 2013 (4 pages).

(Continued)

*Primary Examiner* — Steve Rowland

(74) *Attorney, Agent, or Firm* — Neal, Gerber & Eisenberg LLP

(57) ABSTRACT

Various embodiments of the present disclosure provide a gaming system and method for redeeming a winning ticket and/or a plurality of non-winning tickets having corresponding symbols for an award. Generally, in various embodiments, the gaming system of the present disclosure enables a player to: (a) redeem a winning ticket for a first award, and (b) redeem a set of two or more non-winning tickets having corresponding symbols for a second award. Thus, while an individual ticket may be a non-winning ticket when standing alone, the gaming system of the present disclosure enables that non-winning ticket to provide value to the player (in the form of an award) when combined with at least one additional non-winning ticket.

20 Claims, 8 Drawing Sheets

(58) Field of Classification Search
CPC ..... A63F 3/0655; A63F 2009/242; A63F 2300/407; A63F 3/06
See application file for complete search history.

(56) References Cited

U.S. PATENT DOCUMENTS

| | | | |
|---|---|---|---|
| 5,326,104 | A | 7/1994 | Pease et al. |
| 5,398,932 | A | 3/1995 | Eberhardt et al. |
| 5,833,537 | A | 11/1998 | Barrie |
| 5,931,467 | A | 8/1999 | Kamille |
| 6,107,913 | A | 8/2000 | Gatto et al. |
| 6,113,098 | A | 9/2000 | Adams et al. |
| 6,251,014 | B1 | 6/2001 | Stockdale et al. |
| 6,280,326 | B1 | 8/2001 | Saunders |
| 6,315,291 | B1 | 11/2001 | Moody |
| 6,346,043 | B1 | 2/2002 | Colin et al. |
| 6,364,313 | B1 | 4/2002 | Moody |
| 6,558,256 | B1 | 5/2003 | Saunders |
| 6,579,179 | B2 | 6/2003 | Poole et al. |
| 6,669,599 | B2 | 12/2003 | Iwase et al. |
| 6,676,522 | B2 | 1/2004 | Rowe et al. |
| 6,682,421 | B1 | 1/2004 | Rowe et al. |
| 6,726,563 | B1 | 4/2004 | Baerlocher et al. |
| 6,749,502 | B2 | 6/2004 | Baerlocher |
| 6,752,312 | B1 | 6/2004 | Chamberlain et al. |
| 6,892,182 | B1 | 5/2005 | Rowe et al. |
| 6,896,618 | B2 | 5/2005 | Benoy et al. |
| 6,905,411 | B2 | 6/2005 | Nguyen et al. |
| 6,964,416 | B2 | 11/2005 | McClintic et al. |
| 6,997,805 | B2 | 2/2006 | Vancura |
| 7,040,983 | B2 | 5/2006 | Dolloff et al. |
| 7,128,646 | B2 | 10/2006 | Baerlocher et al. |
| 7,179,168 | B1 | 2/2007 | Tulley et al. |
| 7,328,838 | B2 | 2/2008 | Brosnan et al. |
| 7,331,520 | B2 | 2/2008 | Silva et al. |
| 7,399,226 | B2 | 7/2008 | Mishra |
| 7,559,462 | B2 | 7/2009 | Brosnan et al. |
| 7,572,183 | B2 | 8/2009 | Olivas et al. |
| 7,674,180 | B2 | 3/2010 | Graham et al. |
| 7,686,687 | B2 | 3/2010 | Cannon et al. |
| 7,722,453 | B2 | 5/2010 | Lark et al. |
| 7,740,243 | B1 | 6/2010 | Kean |
| 7,749,079 | B2 | 7/2010 | Chamberlain et al. |
| 7,771,277 | B2 | 8/2010 | Chamberlain et al. |
| 7,785,193 | B2 | 8/2010 | Paulsen et al. |
| 7,789,755 | B2 | 9/2010 | Davis et al. |
| 7,833,102 | B2 | 11/2010 | Beadell et al. |
| 7,862,430 | B2 | 1/2011 | Baerlocher et al. |
| 7,874,908 | B2 | 1/2011 | Walker et al. |
| 7,883,409 | B2 | 2/2011 | Little et al. |
| 7,887,404 | B2 | 2/2011 | Saffari et al. |
| 7,909,699 | B2 | 3/2011 | Parrott et al. |
| 7,967,677 | B2 | 6/2011 | Baerlocher et al. |
| 7,985,133 | B2 | 7/2011 | Baerlocher et al. |
| 7,993,197 | B2 | 8/2011 | Kaminkow |
| 8,002,620 | B2 | 8/2011 | Nicely et al. |
| 8,043,152 | B2 | 10/2011 | Walker et al. |
| 8,092,302 | B2 | 1/2012 | Cuddy et al. |
| 8,096,884 | B2 | 1/2012 | Beadell et al. |
| 8,142,280 | B2 | 3/2012 | Walker et al. |
| 8,152,630 | B2 | 4/2012 | Cohen |
| 8,177,624 | B2 | 5/2012 | Graham et al. |
| 8,177,637 | B2 | 5/2012 | Beadell et al. |
| 8,241,111 | B2 | 8/2012 | Manfredi et al. |
| 8,277,302 | B2 | 10/2012 | Walker et al. |
| 8,308,554 | B2 | 11/2012 | Rowe et al. |
| 8,376,836 | B2 | 2/2013 | Baerlocher et al. |
| 8,382,572 | B2 | 2/2013 | Hoffman et al. |
| 8,419,526 | B1 | 4/2013 | Cannon et al. |
| 8,425,303 | B2 | 4/2013 | Kennedy et al. |
| 8,602,874 | B2 | 12/2013 | Rowe et al. |
| 8,613,659 | B2 | 12/2013 | Nelson et al. |
| 8,628,413 | B2 | 1/2014 | LeMay et al. |
| 2003/0050111 | A1 | 3/2003 | Saffari et al. |
| 2004/0033095 | A1 | 2/2004 | Saffari et al. |
| 2004/0142744 | A1 | 7/2004 | Atkinson et al. |
| 2004/0176154 | A1 | 9/2004 | Finnochio |
| 2004/0176158 | A1 | 9/2004 | Baldwin |
| 2005/0054439 | A1 | 3/2005 | Rowe et al. |
| 2005/0107163 | A1 | 5/2005 | Nguyen et al. |
| 2005/0215316 | A1 | 9/2005 | Rowe et al. |
| 2006/0012116 | A1 | 1/2006 | Lovell, Sr. |
| 2006/0046827 | A1 | 3/2006 | Saffari et al. |
| 2006/0046842 | A1 | 3/2006 | Mattice et al. |
| 2006/0105836 | A1 | 5/2006 | Walker et al. |
| 2006/0154723 | A1 | 7/2006 | Saffari et al. |
| 2007/0106553 | A1 | 5/2007 | Jordan et al. |
| 2007/0117608 | A1 | 5/2007 | Roper et al. |
| 2008/0026823 | A1 | 1/2008 | Wolf et al. |
| 2008/0039190 | A1 | 2/2008 | Walker et al. |
| 2008/0045299 | A1 | 2/2008 | Bennett et al. |
| 2008/0070652 | A1 | 3/2008 | Nguyen et al. |
| 2008/0076528 | A1 | 3/2008 | Nguyen et al. |
| 2008/0076542 | A1 | 3/2008 | Iddings et al. |
| 2008/0113715 | A1 | 5/2008 | Beadell et al. |
| 2008/0113716 | A1 | 5/2008 | Beadell et al. |
| 2008/0113821 | A1 | 5/2008 | Beadell et al. |
| 2008/0132314 | A1 | 6/2008 | Robb et al. |
| 2008/0214310 | A1 | 9/2008 | Brunet de Courssou et al. |
| 2008/0234029 | A1 | 9/2008 | Cannon et al. |
| 2008/0248865 | A1 | 10/2008 | Tedesco et al. |
| 2008/0274792 | A1 | 11/2008 | Walker et al. |
| 2009/0131155 | A1 | 5/2009 | Hollibaugh et al. |
| 2009/0156303 | A1 | 6/2009 | Kiely et al. |
| 2010/0081497 | A1 | 4/2010 | Wolf et al. |
| 2010/0113122 | A1 | 5/2010 | Walker et al. |
| 2010/0137056 | A1 | 6/2010 | Hoffman et al. |
| 2011/0003627 | A1 | 1/2011 | Nicely et al. |
| 2012/0040751 | A1 | 2/2012 | Peters |
| 2012/0077578 | A1 | 3/2012 | Walker et al. |
| 2012/0214580 | A1 | 8/2012 | Hoffman et al. |
| 2013/0065668 | A1 | 3/2013 | LeMay et al. |
| 2013/0065678 | A1 | 3/2013 | Nelson et al. |
| 2013/0065686 | A1 | 3/2013 | LeMay et al. |
| 2013/0079098 | A1 | 3/2013 | Nicely et al. |
| 2013/0079123 | A1 | 3/2013 | Nicely et al. |
| 2013/0095904 | A1 | 4/2013 | Cannon et al. |
| 2013/0178269 | A1* | 7/2013 | Shaw ..... G07F 17/3244 463/16 |
| 2014/0295932 | A1* | 10/2014 | Irwin, Jr. ..... G07F 17/329 463/17 |

OTHER PUBLICATIONS

Hollywood Casino, Texas Hold-Em Bad Beat Jackpot General Rules, available at http://web.archive.org/web/20130401055415/http://www.hollywoodcasinotoledo.com/Casino/Poker%20Room/Bad%20Beat%20Jackpot%20Rules, Apr. 1, 2013 (2 pages).

* cited by examiner

GAMING SYSTEM AND METHOD FOR REDEEMING A WINNING TICKET AND/OR A PLURALITY OF NON-WINNING TICKETS HAVING CORRESPONDING SYMBOLS FOR AN AWARD

PRIORITY CLAIM

This application is a continuation of, and claims priority to and the benefit of, U.S. patent application Ser. No. 14/021,725, which was filed on Sep. 9, 2013, the entire contents of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Instant lottery tickets, sometimes referred to as scratch-off tickets, are also known. An instant lottery ticket typically includes a physical card printed with a potential award (or awards). The potential award (or awards) is covered by a removable material. A player purchases the instant lottery ticket and removes the removable material (such as by scratching off the removable material) to determine whether the player wins the prize (or prizes) printed on the card. In other words, unlike traditional lotteries in which a player must wait for a drawing to occur to determine whether the player's ticket is a winning ticket, instant lottery tickets enable a player to determine whether the player's ticket is a winning ticket immediately after the player purchases the ticket.

One major drawback associated with instant lottery tickets is that most instant lottery tickets provide limited entertainment value to players—it only takes the player a few seconds to remove the removable material to determine if the ticket is a winning ticket. Another major drawback associated with instant lottery tickets is that the majority of instant lottery tickets are non-winning tickets. Thus, frequent players and purchasers of instant lottery tickets often end up with stacks of useless, non-winning tickets.

One known attempt to mitigate these drawbacks is to offer a second chance drawing. To enter the second-chance drawing, a player may mail a quantity of one or more non-winning instant lottery tickets to the lottery provider, and each of the tickets is entered in a drawing. If one of the player's tickets is drawn when the drawing is conducted, the player wins a second chance award. This attempted solution does not, however, solve the above-described problems. Simply mailing a non-winning ticket to the lottery provider to be entered into a drawing with typically extremely low chances of winning is not exciting or fun for most players.

A continuing need thus exists for gaming systems and methods that provide new, exciting, and engaging ways for players to utilize non-winning lottery or other instant win tickets.

SUMMARY

Various embodiments of the present disclosure provide a gaming system and method for redeeming a winning ticket and/or a plurality of non-winning tickets having corresponding symbols for an award. Generally, in various embodiments, the gaming system of the present disclosure enables a player to: (a) redeem a winning ticket for a first award, and (b) redeem a set of two or more non-winning tickets having corresponding symbols for a second award. Thus, while an individual ticket may be a non-winning ticket when standing alone, the gaming system of the present disclosure enables that non-winning ticket to provide value to the player (in the form of an award) when combined with at least one additional non-winning ticket.

More specifically, in operation of one embodiment, the gaming system receives one or more tickets, each of which is associated with one of a plurality of different symbols. The gaming system determines whether each received ticket is a winning ticket or a non-winning ticket. For each of any received winning tickets, the gaming system displays at least one free play of a first game. If a plurality of the received tickets are non-winning tickets, the gaming system determines whether the symbols of a designated number of at least two of the received non-winning tickets correspond to one another. If the symbols of the designated number of the received non-winning tickets correspond to one another, the gaming system displays at least one free play of a second game.

In operation of another embodiment, the gaming system receives one or more tickets, each of which is associated with at least one of a plurality of different symbols. The gaming system determines whether each received ticket is a winning ticket or a non-winning ticket. For each of any received winning tickets, the gaming system displays at least one free play of a first game. If a plurality of the received tickets are non-winning tickets, the gaming system determines whether at least two of the received non-winning tickets are collectively associated with a designated number of at least two designated symbols. If at least two of the received non-winning tickets are collectively associated with the designated number of designated symbols, the gaming system displays at least one free play of a second game.

It should thus be appreciated that the gaming system and method of the present disclosure provides new, exciting, and engaging ways for players to utilize non-winning lottery or other instant win tickets.

Additional features and advantages are described herein, and will be apparent from, the following Detailed Description and the Figures.

DETAILED DESCRIPTION

Redeeming a Winning Ticket and/or a Plurality of Non-Winning Tickets Having Corresponding Symbols for an Award Various embodiments of the present disclosure provide a gaming system and method for redeeming a winning ticket and/or a plurality of non-winning tickets having corresponding symbols for an award. Generally, in various embodiments, the gaming system of the present disclosure enables a player to: (a) redeem a winning ticket for a first award, and (b) redeem a set of two or more non-winning tickets having corresponding symbols for a second award. Thus, while an individual ticket may be a non-winning ticket when standing alone, the gaming system of the present disclosure enables that non-winning ticket to provide value to the player (in the form of an award) when combined with at least one additional non-winning ticket.

Figure 1:
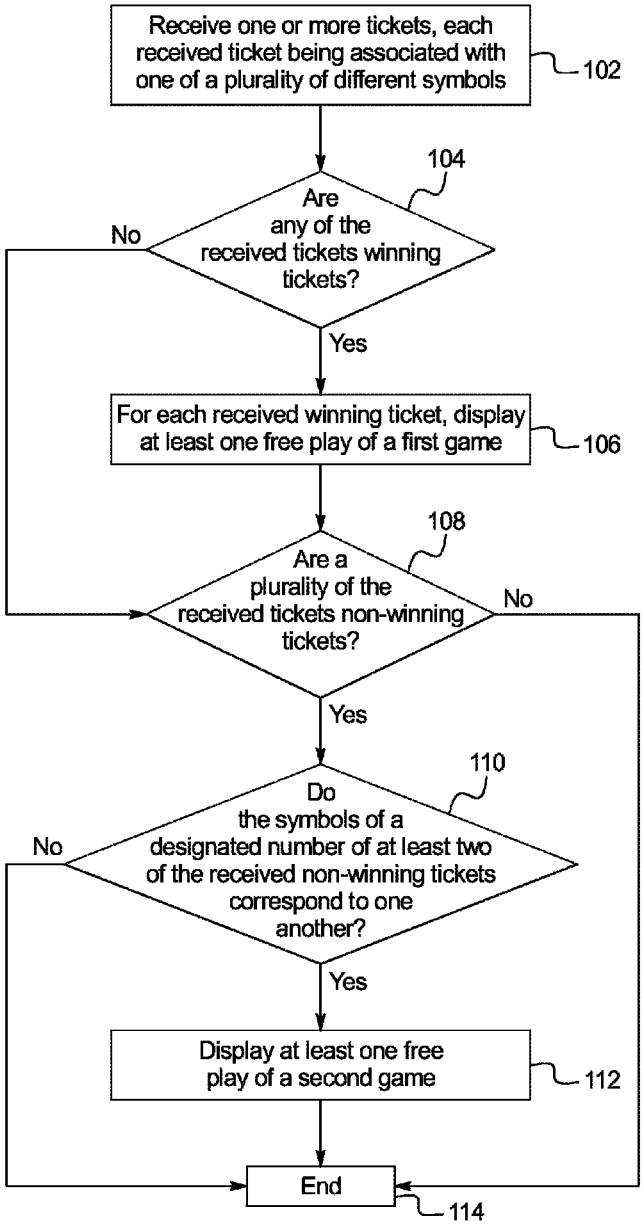
FIG. 1 is a flowchart illustrating an example method of operating one embodiment of the gaming system of the present disclosure.

FIG. 1 is a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated the process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system receives one or more tickets, as indicated by block 102. Each received ticket is associated with one of a plurality of different symbols. The gaming system determines whether any of the received tickets are winning tickets, as indicated by diamond 104. If the gaming system determines that none of the received tickets are winning tickets, the process 100 proceeds to diamond 108, described below. If, on the other hand, the gaming system determines that at least one of the received tickets is a winning ticket, for each received winning ticket, the gaming system displays at least one free play of a first game, as indicated by block 106.

The gaming system determines whether a plurality of the received tickets are non-winning tickets, as indicated by diamond 108. If the gaming system determines that a plurality of the received tickets are not non-winning tickets, the process 100 proceeds to block 114 and ends. If, on the other hand, the gaming system determines that a plurality of the received tickets are non-winning tickets, the gaming system determines if the symbols of a designated number of at least two of the received non-winning tickets correspond to one another, as indicated by diamond 110.

If the gaming system determines that the symbols of the designated number of the received non-winning tickets do not correspond to one another, the process 100 proceeds to block 114 and ends. If, on the other hand, the gaming system determines that the symbols of the designated number of the received non-winning tickets correspond to one another, the gaming system displays at least one free play of a second game (which may be the same as or different than the first game), as indicated by block 112. The process 100 then proceeds to block 114 and ends.

It should be appreciated that the ticket may be any suitable ticket associated with any suitable primary game such that the ticket is either a winning ticket for the primary game or a non-winning ticket for the primary game. For instance, in one example embodiment, the ticket is associated with an instant-win game (i.e., a primary game). In this example embodiment, the player purchases a ticket and removes removable material on the player's ticket to determine whether the player's ticket is a winning ticket or a non-winning ticket for the instant-win game. If the player's ticket is a winning ticket, the gaming system enables the player to redeem the player's winning ticket, and if the player's ticket is a non-winning ticket, the gaming system enables the player to redeem the player's non-winning ticket along with one or more additional non-winning tickets displaying a symbol(s) corresponding to the symbol of the player's non-winning ticket.

In another example embodiment, the ticket is associated with a raffle or drawing (i.e., a primary game). In this example embodiment, the player purchases a ticket waits for the winning ticket(s) or ticket number(s) to be drawn to determine the results of the raffle or drawing. If the player's ticket is a winning ticket, the gaming system enables the player to redeem the player's winning ticket, and if the player's ticket is a non-winning ticket, the gaming system enables the player to redeem the player's non-winning ticket along with one or more additional non-winning tickets displaying a symbol(s) corresponding to the symbol of the player's non-winning ticket.

It should thus be appreciated that a winning ticket is a ticket associated with an award for the primary game, and a non-winning ticket is a ticket that is not associated with any award for the primary game.

It should be appreciated that a ticket may include any suitable identifier, such as (but not limited to) a barcode, a serial number, a Quick Response code (QR code), a radio-frequency identification tag (RFID tag), and/or a unique numeric or alphanumeric identification code.

It should be appreciated that a ticket may include any one of a plurality of different symbols or any plurality of the plurality of different symbols. It should also be appreciated that the symbol on a ticket may be any suitable symbol, such as (but not limited to): (a) a symbol associated with the primary game associated with the ticket, (b) a symbol not associated with the primary game associated with the ticket, (c) a symbol covered by removable material on the ticket, (d) a symbol not covered by removable material on the ticket, and/or (e) a symbol otherwise used for identification of the ticket.

Figure 2A:
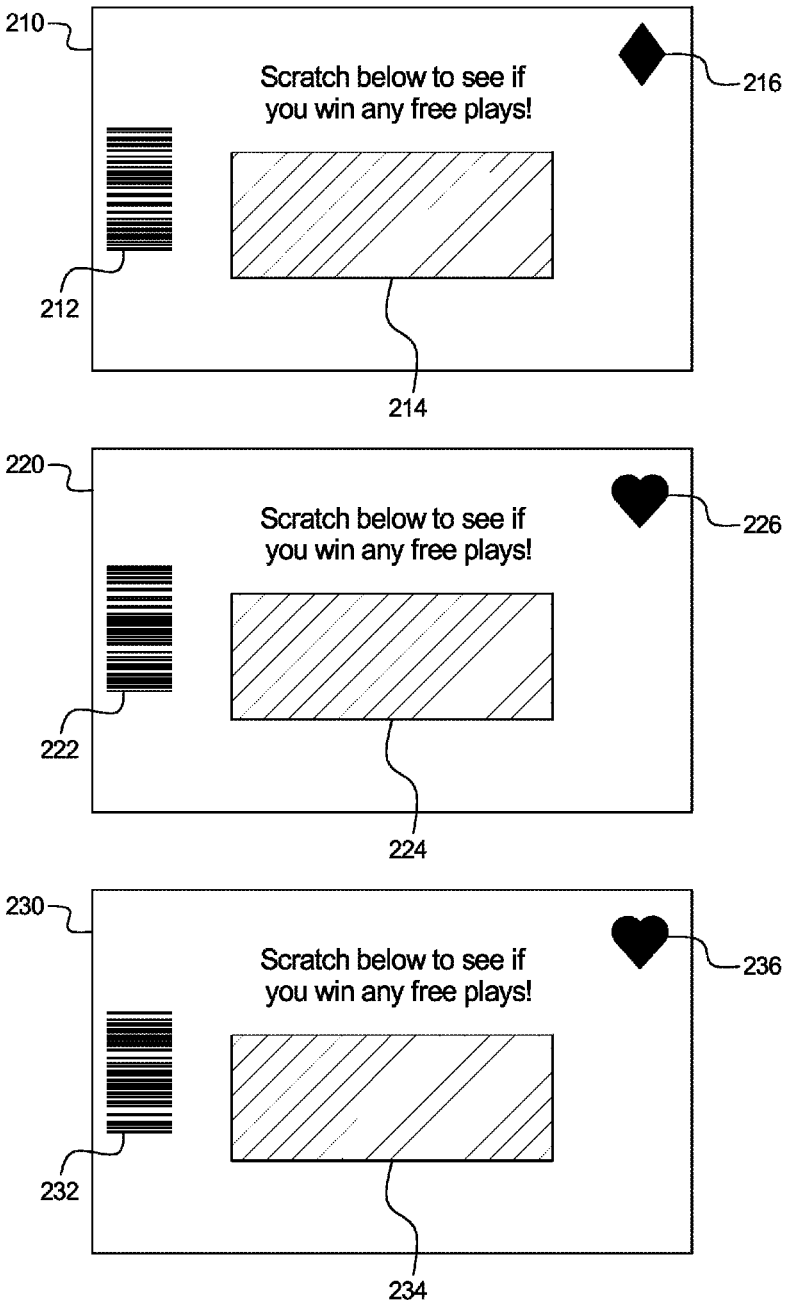
FIG. 2A illustrates a plurality of example tickets before any awards associated with the tickets are revealed

FIG. 2A illustrates a plurality of example tickets 210, 220, and 230 associated with an instant-win game (i.e., a primary game) before any awards associated with the instant-win game are revealed. The ticket 210 includes an identifier, such as barcode 212, used to identify the ticket 210; an award display area 214 that displays any instant-win game award associated with the ticket 210 and that is initially covered by removable material; and a diamond symbol 216. The ticket 220 includes an identifier, such as a barcode 222, used to identify the ticket 220; an award display area 224 that displays any instant-win game award associated with the ticket 220 and that is initially covered by removable material; and a heart symbol 226. The ticket 230 includes an identifier, such as a barcode 232, used to identify the ticket 230; an award display area 234 that displays any instant-win game award associated with the ticket 230 and that is initially covered by removable material; and a heart symbol 235.

Figure 2B:
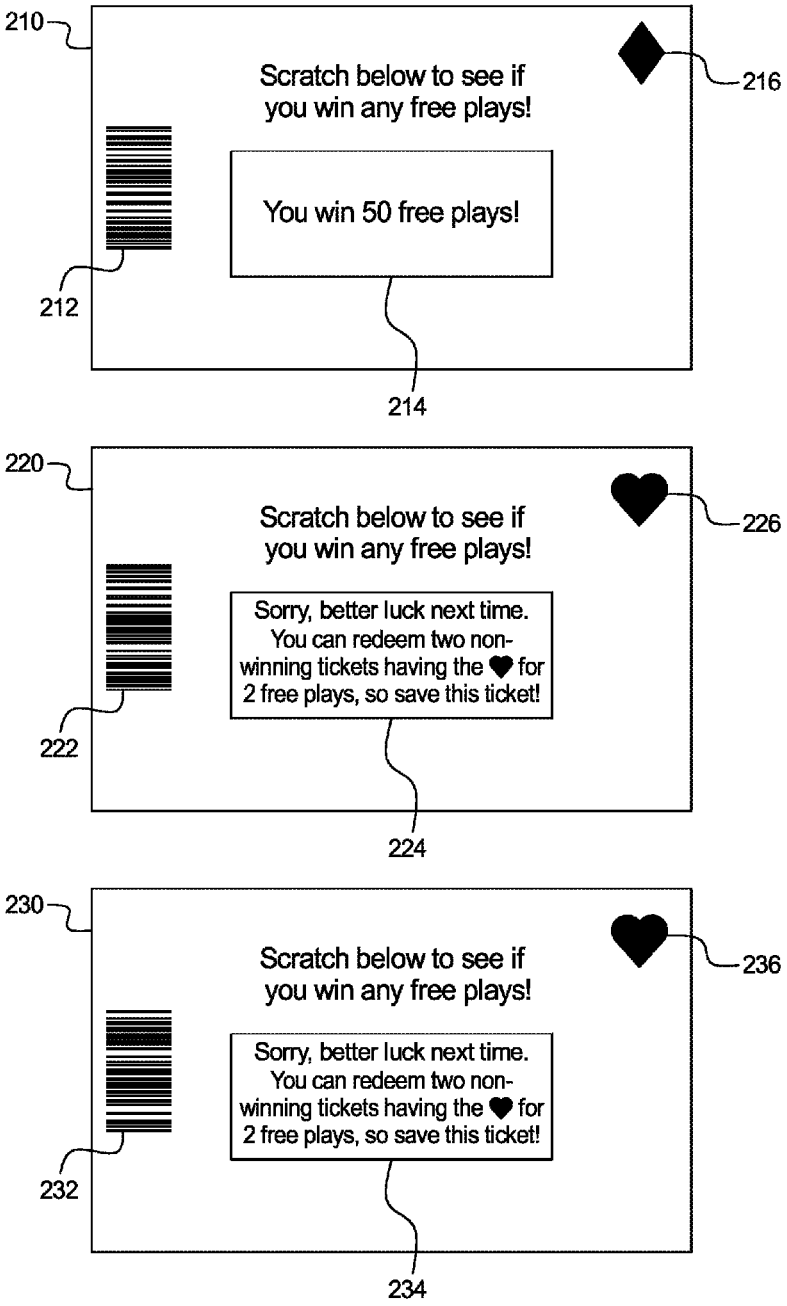
FIG. 2B illustrates the tickets of FIG. 2A after any awards associated with the tickets are revealed

FIG. 2B illustrates the example tickets 210, 220, and 230 after the removable material is removed and the instant-win game awards (if any) associated with the tickets are revealed. In this example embodiment, the ticket 210 is a winning ticket and is associated with an instant-win game award of fifty free plays of a wagering game, and the tickets 220 and 230 are non-winning tickets (i.e., are not associated with any instant-win game awards). In this example embodiment, as shown in the award display areas 224 and 234 of the non-winning tickets 220 and 230, the gaming system enables two non-winning tickets having corresponding (i.e., matching in this example embodiment) heart symbols to be redeemed for two free plays of the wagering game.

Figure 3:
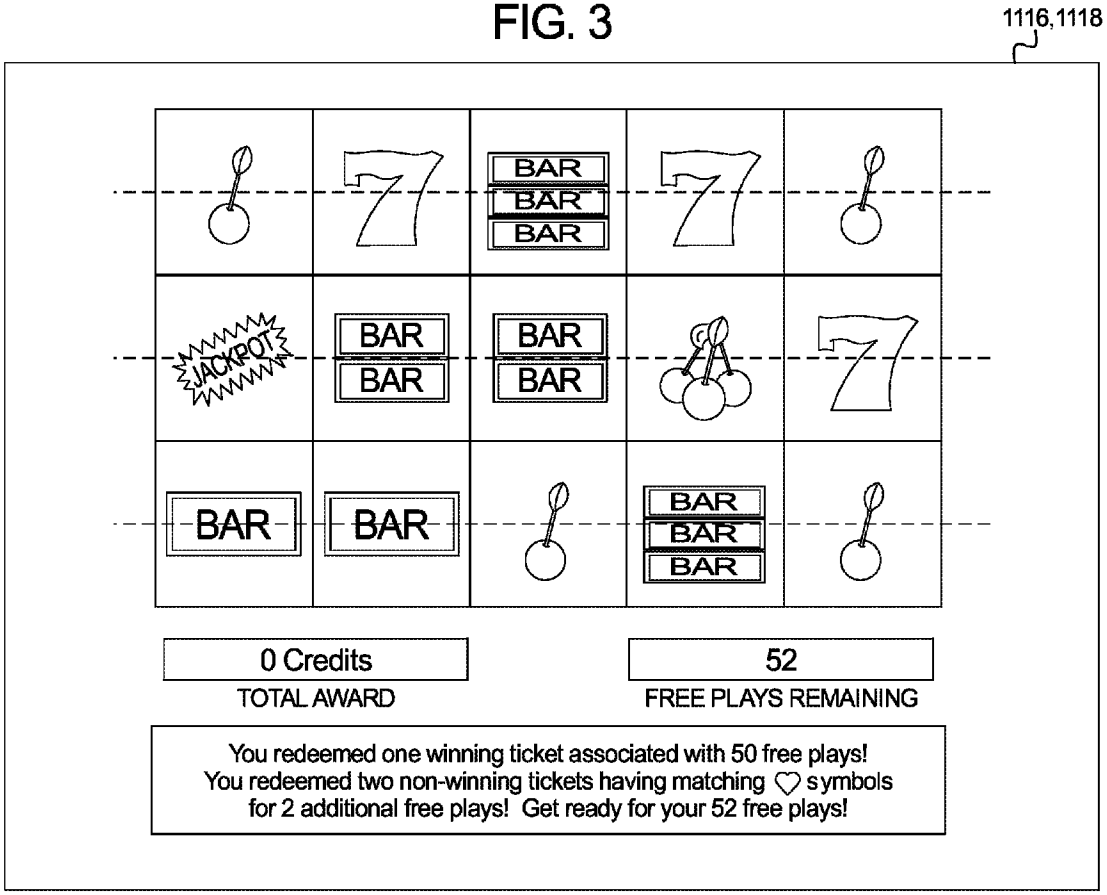
FIG. 3 illustrates a screen shot of one example embodiment of the gaming system of the present disclosure after receiving the tickets of FIG. 2A and redeeming the tickets for their associated awards.

FIG. 3 illustrates a screen shot of one example embodiment of the gaming system of the present disclosure after receiving the tickets 210, 220, and 230. More specifically, after receiving the tickets 210, 220, and 230, the gaming system: (a) determines that the ticket 210 is a winning ticket and credits the player with the fifty free plays of the wagering game (i.e., the instant-win game award associated with the ticket 210); (b) determines that the tickets 220 and 230 are both non-winning tickets having the heart symbol; and (c) credits the player with two free plays associated with the two received non-winning tickets associated with the corresponding (i.e., matching in this example embodiment) heart symbol. Thus, the gaming system credits the player with a total of fifty-two free plays of the wagering game associated with the three redeemed tickets.

It should thus be appreciated that, in the example embodiments described above with respect to FIGS. 1, 2A, 2B, and 3, each of the tickets is associated with one of a plurality of different symbols, and the gaming system enables a player to redeem a designated quantity of at least two non-winning tickets having corresponding symbols for an award.

In various embodiments, each of the tickets is associated with one of a plurality of different symbols or a plurality of the plurality of different symbols. For example, a given ticket may be associated with: (a) a single instance of one of the symbols (e.g., one heart symbol); (b) a single instance of each of a plurality of the symbols (e.g., one heart symbol and one spade symbol); (c) multiple instances of one of the symbols (e.g., two heart symbols); (d) multiple instances of a plurality of the symbols (e.g., two heart symbols and two spade symbols); or (e) any combination thereof. In these embodiments, the gaming system enables a player to redeem at least two non-winning tickets that are collectively associated with a designated number of at least two corresponding symbols for an award. For instance, in one example embodiment, the gaming system enables a player to redeem at least two non-winning tickets collectively associated with four instances of a heart symbol for an award. In this example embodiment, the gaming system receives one non-winning ticket associated with three instances of the heart symbol and another non-winning ticket associated with one instance of the heart symbol. Thus, in this example embodiment, the gaming system received at least two tickets collectively associated with four instances of the heat symbol and, therefore, provides the award to the player.

It should be appreciated that symbols may correspond to one another in any suitable manner. In certain embodiments, symbols having a designated relationship with one another correspond to one another. The designated relationship may be any suitable relationship, such as (but not limited to): (a) the symbols matching one another (e.g., two Seven symbols match and, therefore, correspond to one another); (b) the symbols sharing a common theme (e.g., two symbols share a sports theme and, therefore, correspond to one another); (c) the symbols sharing a same color (e.g., two symbols are blue and, therefore, correspond to one another); (d) the symbols sharing a same pattern (e.g., two symbols are checkered and, therefore, correspond to one another); (e) in an embodiment in which the symbols are letters, the symbols forming a target word (e.g., the symbols "C", "A", and "R" form the target word "CAR" and, therefore, correspond to one another); (f) in an embodiment in which the symbols are words, the symbols forming a target phrase (e.g., the symbols "YOU", "WIN", "A", and "TRIP" form the target phrase "YOU WIN A TRIP" and, therefore, correspond to one another); (g) in an embodiment in which the symbols are playing cards, the symbols forming a winning poker hand (e.g., the symbols A♥, K♥, Q♥, J♥, and 10♥ form a Royal Flush and, therefore, correspond to one another); and/or (h) in an embodiment in which the symbols are numbers, the symbols adding up to a number at least equal to a target number (e.g., the symbols "10", "9", and "2" at least equal the target number "21" and, therefore, correspond to one another).

While the awards described above are one or more free plays of one or more games, it should be appreciated that such redeemed winning tickets and redeemed sets of two or more non-winning tickets having corresponding symbols may be associated with any suitable award or award opportunity such as, but not limited to: (1) monetary credits or currency; (2) non-monetary credits or currency; (3) a modifier such as a multiplier used to modify one or more awards; (4) one or more free plays of a game (such as one or more free spins of a spinning reel type game); (5) one or more plays of one or more bonus games (such as a free spin of an award wheel); (6) one or more lottery based awards (such as one or more lottery or drawing tickets); (7) a wager match for one or more plays of the a wagering game; (8) an increase in an average expected payback percentage of a bonus game and/or an average expected payback percentage of a primary wagering game for one or more plays; (9) one or more comps (such as a free dinner or a free night's stay at a hotel); (10) one or more bonus or promotional credits usable for online play; (11) one or more player tracking points; (12) a multiplier for player tracking points or credits; (13) an increase in a membership or player tracking level; (14) one or more coupons or promotions usable within a gaming establishment and/or outside of the gaming establishment (e.g., a 20% off coupon for use at a retail store or a promotional code providing a deposit match for use in association with an online casino); (15) an access code usable to unlock content on the Internet; (16) a progressive jackpot or other progressive award; (17) a high value product or service (such as a car); and (18) a low value product or service (such as a teddy bear).

In certain embodiments, each winning ticket is associated with one of a plurality of different awards. That is, in these embodiments, at least one winning ticket is associated with a first one of the awards and at least one other winning ticket is associated with a second different one of the awards. For instance, in one example embodiment, each winning ticket is associated with one of the following awards: 100 free plays, 50 free plays, 25 free plays, 2 free plays, and 1 free play.

In various embodiments, different quantities of redeemed non-winning tickets having corresponding symbols are associated with different awards. Put differently, when the gaming system receives a set of two or more non-winning tickets having corresponding symbols in these embodiments, the gaming system determines which of a plurality of different awards to provide based on a received quantity of non-winning tickets having corresponding symbols. In one embodiment, the more non-winning tickets having corresponding symbols the gaming system receives (i.e., the more non-winning tickets having corresponding symbols redeemed), the more valuable the award. For instance, in one example embodiment, the gaming system provides: (a) an award of 1 free play when the gaming system receives two non-winning tickets having corresponding symbols (i.e., when two non-winning tickets having corresponding symbols are redeemed); (b) an award of 2 free plays when the gaming system receives four non-winning tickets having corresponding symbols; (c) an award of 3 free plays when the gaming system receives eight non-winning tickets having corresponding symbols; and (d) an award of 4 free plays when the gaming system receives sixteen non-winning tickets having corresponding symbols.

In various embodiments, a first set of redeemed non-winning tickets having a first type of corresponding symbols is associated with a first award and a second different set of redeemed non-winning tickets having a second different type of corresponding symbols is associated with a second different award. For instance, in one example embodiment in which matching symbols correspond to one another, the gaming system provides: (a) a first award of 2 free plays when the gaming system receives two non-winning tickets each having a Cherry symbol; and (b) a second award of 10 free plays when the gaming system receives two non-winning tickets each having a Seven symbol (which is rarer than the Cherry symbol in this example embodiment).

In certain embodiments in which at least one of the awards is a quantity of free plays: (a) at least one of the free plays is usable only at an electronic gaming machine (EGM) of a particular denomination (e.g., an award of 2 free plays at a $0.25 denomination); (b) at least one of the free plays is usable only with games of a particular game theme (e.g., games having an "under the sea" theme); (c) at least one of the free plays is usable only with a particular game or games of a particular set or group of games; (d) at least one of the free plays is usable only with games having particular bonus games or features; (e) at least one of the free plays is usable only with games that contribute to a particular progressive award; (f) at least one of the free plays is usable only with games provided by a particular manufacturer; and/or (g) at least one of the free plays is usable only with games at a particular gaming establishment (brick-and-mortar or virtual).

It should be appreciated that the tickets may be virtual tickets or physical tickets. In certain embodiments in which the tickets are virtual tickets, the gaming system stores any tickets provided to a player but not yet redeemed by the player in association with the player's player tracking account (or in any other suitable manner) to enable the player to easily maintain the player's collection of unredeemed tickets. For instance, in one example embodiment, if the player purchases two tickets that are non-winning tickets and that do not have symbols that correspond to one another, the gaming system stores data representing those tickets in association with the player's player tracking account so that the player may redeem those tickets at a later time. In other embodiments in which the tickets are virtual tickets, the gaming system enables the player to store the virtual tickets on a memory device of the player, such as a USB drive or the memory of the player's cellular phone. In certain embodiments in which the tickets are physical tickets the tickets are shaped such that a bill acceptor of the gaming system may receive the tickets.

It should be appreciated that the gaming system may receive the tickets in any suitable manner. In various embodiments in which the tickets are physical tickets, the gaming system receives a ticket via one or more of: (a) an input device of the gaming system (e.g., via a bill acceptor of an EGM (described below)); (b) a barcode scanner (e.g., a player scans the barcode of a ticket using a barcode scanner of the gaming system when the player desires to redeem the ticket); (c) via a QR scanner (e.g., a player scans the QR code of a ticket using a QR code scanner of the gaming system when the player desires to redeem the ticket); and (d) via a unique code (such as a numerical or alphanumerical code) associated with the ticket (e.g., the player inputs a unique code associated with the ticket using an input device of the gaming system when the player desires to redeem the ticket).

In various embodiments in which the tickets are virtual tickets, the gaming system receives a ticket via one or more of: (a) a barcode scanner (e.g., a player scans the barcode of a virtual ticket displayed on the user's smartphone using a barcode scanner of the gaming system when the player desires to redeem the ticket); (b) via a QR code scanner (e.g., a player scans the QR code of a virtual ticket displayed on the user's smartphone using a QR code scanner of the gaming system when the player desires to redeem the ticket); (c) via a unique code (such as a numerical or alphanumerical code) associated with the ticket (e.g., the player inputs a unique code associated with the ticket using an input device of the gaming system when the player desires to redeem the ticket); and (d) via an instruction provided to the gaming system (e.g., the player actuates a "Redeem Now" button of the gaming system associated with a ticket when the player desires to redeem the ticket).

It should be appreciated that a player may obtain one or more tickets in any suitable manner. For instance, in various embodiments, the player purchases one or more tickets using monetary currency (e.g., pays $1.00 in exchange for a ticket), any suitable non-monetary currency (e.g., pays 100 player tracking points in exchange for a ticket), or a combination thereof (e.g., pays $0.50 and 50 player tracking points in exchange for a ticket). In certain embodiments, the player purchases one or more tickets from a brick-and-mortar establishment (such as a brick-and-mortar casino), while in other embodiments the player purchases one or more tickets from a virtual establishment (such as an online or web-based casino). In another embodiment, a gaming establishment provides the player one or more tickets as a comp. In other embodiments, an establishment provides the player one or more tickets as a promotion (such as via a promotional mailer). In certain embodiments, the gaming system provides the player one or more tickets as an award (such as when a designated symbol combination is displayed as a result of a play of a slot game or randomly as a mystery award).

In one embodiment, the gaming system includes a service window and enables the player to purchase and redeem tickets using the service window. For example, while the player is playing a wagering game on the gaming system, the gaming system enables the player to purchase one or more tickets using the service window to attempt to win free plays of the wagering game that the player is currently playing. The gaming system displays the purchased ticket(s) in the service window and displays whether each purchased ticket is a winning ticket (and any associated award of at least one free play of the wagering game) or a non-winning ticket. The gaming system enables the player to redeem each winning ticket for its associated award (at least one free play in this example embodiment). The gaming system also enables the player to redeem a plurality of corresponding non-winning tickets for an award (at least one free play in this example embodiment). It should be appreciated that, in other embodiments, the gaming system does so in association with a player tracking display instead of (or in addition to) a service window.

In certain embodiments, the gaming system provides a player with one or more virtual tickets on the player's personal user device, such as the player's smartphone, tablet computing device, or other mobile computing device. In this embodiment, the gaming system is configured to communicate with or otherwise interface with the player's mobile computing device when the player desires to redeem any winning tickets and/or any corresponding non-winning tickets. For instance, in one example embodiment, a gaming establishment causes a text message containing a ticket to be sent to a player's smartphone. The player opens the text message and discovers that the ticket is a winning ticket associated with an award of 10 free plays of a slot game. When the player travels to the gaming establishment and desires to redeem the winning ticket to obtain the 10 free plays, the gaming system communicates with or otherwise interfaces with the player's smartphone to redeem the winning ticket.

It should be appreciated that instead of (or in addition to) the gaming system providing and/or redeeming tickets, a server or central controller, such as a lottery server, separate from and in addition to the gaming system operates with the gaming system to provide and/or redeem tickets.

In certain embodiments, the gaming system does not enable a player to redeem winning tickets. That is, in these embodiments, the gaming system enables the player to redeem only a plurality of non-winning tickets having corresponding symbols.

It should be appreciated that:

(a) the plurality of different symbols;
(b) the particular symbol or symbols associated with each ticket;
(c) when symbols correspond to one another;
(d) the designated relationship;
(e) the number of symbols associated with each ticket;
(f) the designated number of non-winning tickets having corresponding symbols;
(g) the designated number of corresponding symbols;
(h) the awards associated with winning tickets;
(i) the awards associated with sets of redeemed non-winning tickets having corresponding symbols;
(j) any restriction on the usage of awards including one or more free plays; and/or
(k) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM configured to operate the primary wagering game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23)

determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

While any credit balances, any wagers, and any awards are described and/or displayed as amounts of monetary currency or credits in the embodiments described herein, one or more of such credit balances, such wagers, and such awards may be for any suitable non-monetary credits or currency, promotional credits, and/or player tracking points or credits.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
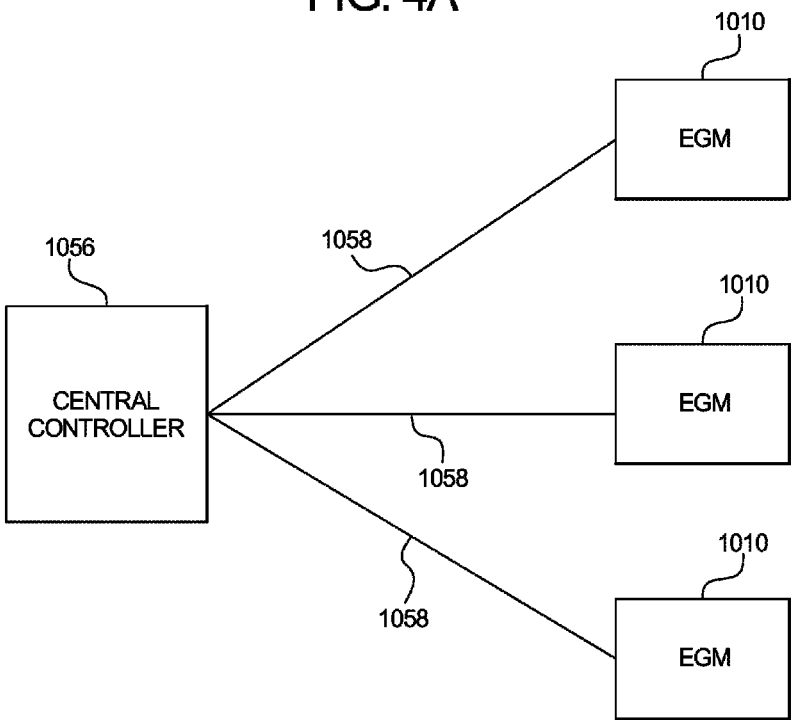
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
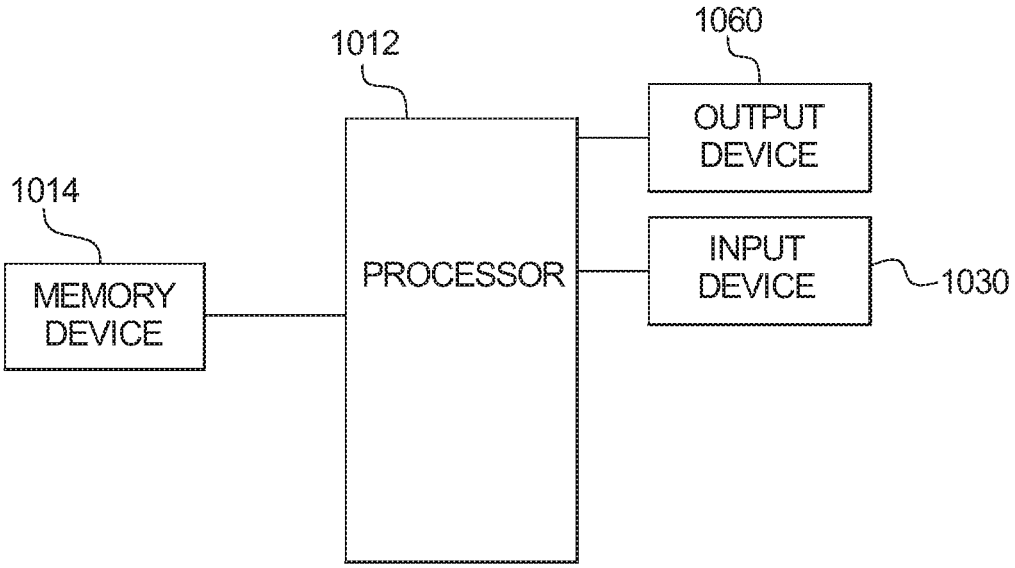
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

Figure 5A:
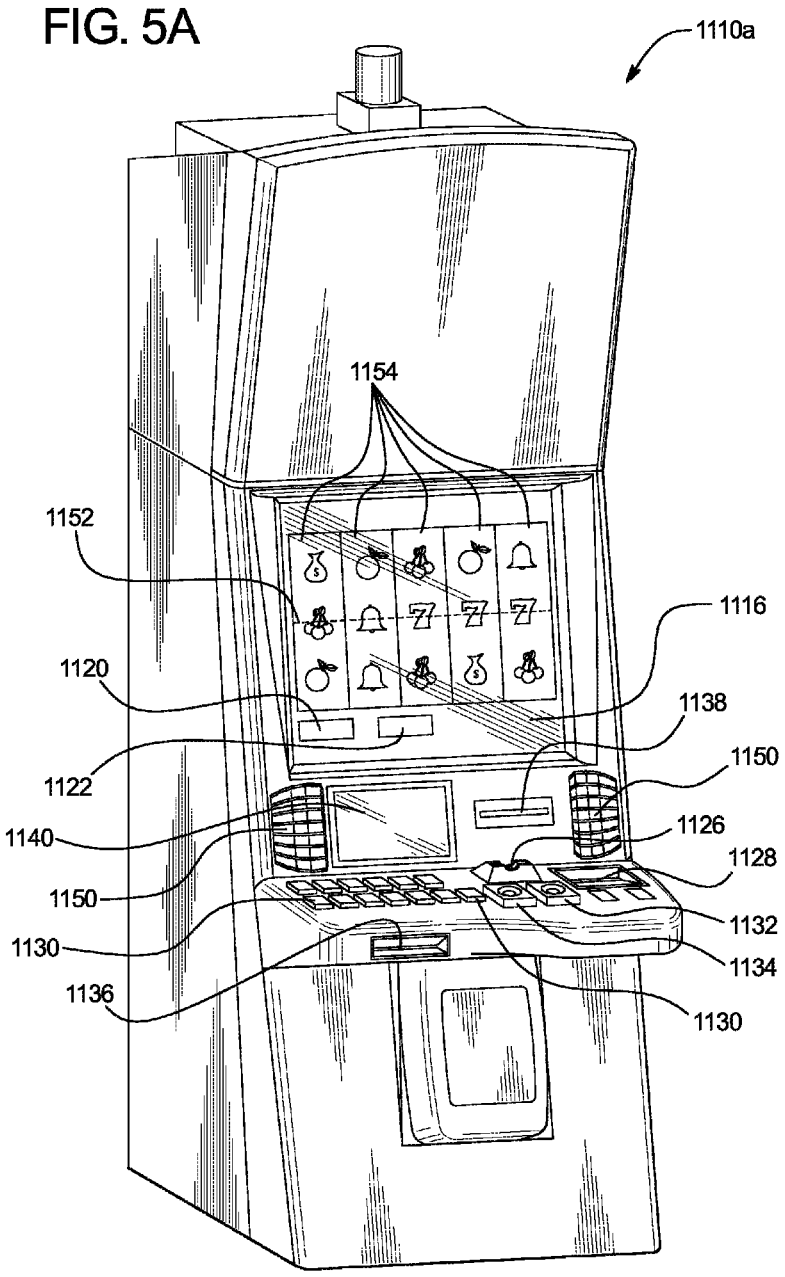
FIGS. 5A and 5B are perspective views of example alternative embodiments of the gaming system of the present disclosure.
Figure 5B:
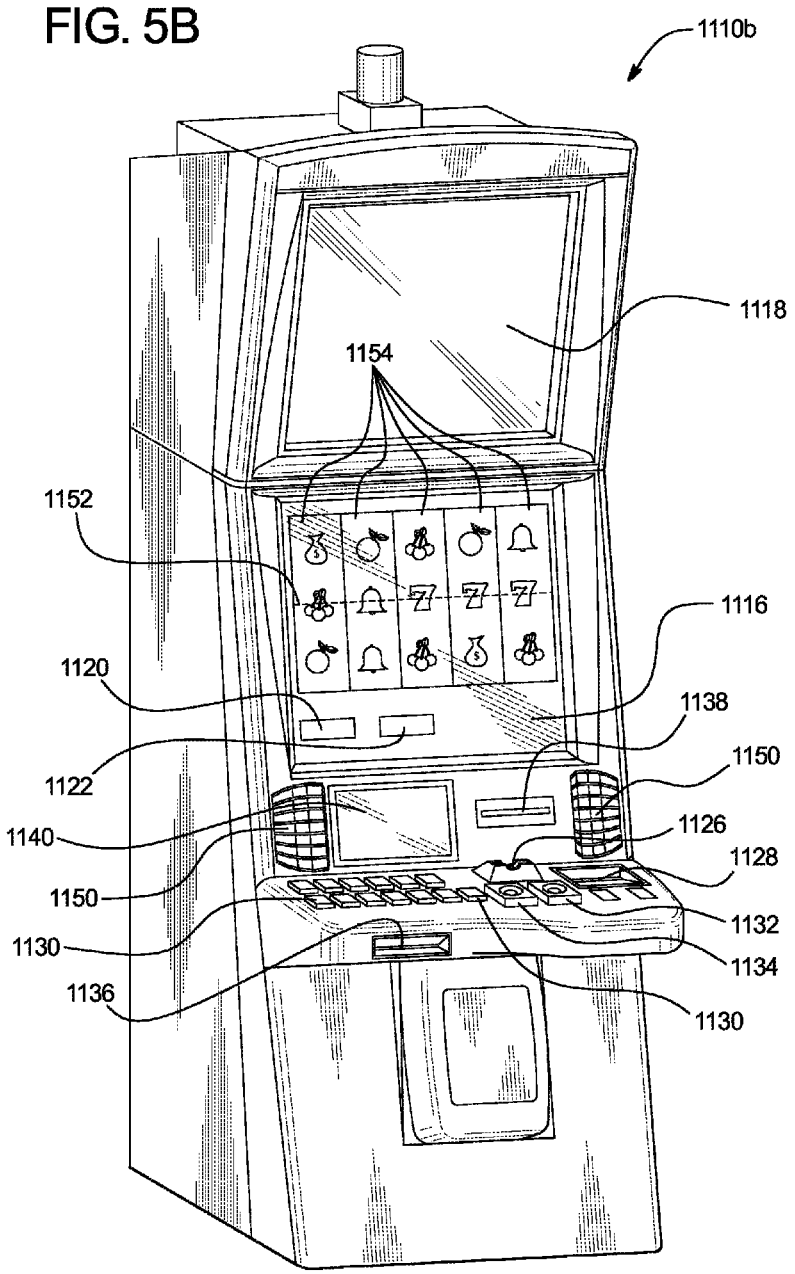

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor; and at least one memory device that stores a plurality of instructions which, when executed by the at least one processor, cause the at least one processor to:

establish communications with a mobile device;

receive, from the mobile device, data associated with one or more virtual tickets, each virtual ticket associated with one of a plurality of different symbols;

determine whether each received virtual ticket is a winning ticket or a non-winning ticket;

responsive to a first quantity of two or more non-winning virtual tickets that have corresponding first symbols being received:

determine a first award, and cause a display, by a display device, of the determined first award; and responsive to a second, different quantity of two or more non-winning virtual tickets that have corresponding first symbols being received:

determine and display a second, different award, and cause a display, by the display device, of the determined second, different award.

2. The gaming system of claim 1, wherein the plurality of instructions, when executed by the at least one processor, cause the at least one processor to, upon an occurrence of a triggering event, cause data associated with a virtual ticket to be transmitted to the mobile device.

3. The gaming system of claim 2, wherein the mobile device is a mobile phone, and wherein the plurality of instructions, when executed by the at least one processor, cause the at least one processor to, upon the occurrence of the triggering event, cause the data associated with the virtual ticket to be transmitted to the mobile phone via a text message.

4. The gaming system of claim 1, wherein the plurality of instructions, when executed by the at least one processor, cause the at least one processor to receive, from the mobile device, the data associated with the one or more virtual tickets following receipt of a ticket redemption input.

5. The gaming system of claim 4, wherein the plurality of instructions, when executed by the at least one processor, cause the at least one processor to:

cause a display, in a service window of the display device, and enable the ticket redemption input via the service window.

6. The gaming system of claim 1, wherein the plurality of instructions, when executed by the at least one processor, cause the at least one processor to, after receiving a virtual ticket purchase input, cause a virtual ticket to be provided.

7. The gaming system of claim 1, wherein symbols correspond to one another when those symbols have a designated relationship with one another.

8. The gaming system of claim 7, wherein matching symbols have the designated relationship with one another.

9. The gaming system of claim 1, which includes an acceptor configured to receive a physical item associated with a monetary value to facilitate establishing a credit balance, the physical item being a ticket associated with the monetary value or currency.

10. A method of operating a gaming system, said method comprising:

establishing communications with a mobile device;

receiving, from the mobile device, data associated with one or more virtual tickets, each virtual ticket associated with one of a plurality of different symbols;

determining, by at least one processor, whether each received virtual ticket is a winning ticket or a non-winning ticket;

responsive to a first quantity of two or more non-winning virtual tickets that have corresponding first symbols being received:

determining, by the at least one processor, a first award, and displaying, by at least one display device, the determined first award; and responsive to a second, different quantity of two or more non-winning virtual tickets that have corresponding first symbols being received:

determining, by the at least one processor, a second different award, and displaying, by the at least one display device, the determined second, different award.

11. The method of claim 10, further comprising, upon an occurrence of a triggering event, causing, by the at least one processor, data associated with a virtual ticket to be transmitted to the mobile device.

12. The method of claim 11, wherein the mobile device is a mobile phone, and which includes, upon the occurrence of the triggering event, causing, by the at least one processor, the data associated with the virtual ticket to be transmitted to the mobile phone via a text message.

13. The method of claim 10, further comprising receiving, from the mobile device, the data associated with the one or more virtual tickets following receipt of a ticket redemption input.

14. The method of claim 13, further comprising displaying, by the at least one display device, a service window and enabling the ticket redemption input via the service window.

15. The method of claim 11, further comprising, after receiving a virtual ticket purchase input, causing, by the at least one processor, a virtual ticket to be provided.

16. The method of claim 11, wherein symbols correspond to one another when those symbols have a designated relationship with one another.

17. The method of claim 16, wherein matching symbols have the designated relationship with one another.

18. The method of claim 11, further comprising receiving, by an acceptor, a physical item associated with a monetary value, the physical item being a ticket associated with the monetary value or currency, and establishing, by the at least one processor, a credit balance based at least in part on the monetary value associated with the received physical item.

19. The method of claim 11, which is at least partially provided through a data network.

20. The method of claim 19, wherein the data network is an internet.

* * * * *